US007685990B2

(12) United States Patent
Dingle

(10) Patent No.: US 7,685,990 B2
(45) Date of Patent: Mar. 30, 2010

(54) DUAL MODE COMBUSTION APPARATUS AND METHOD

(75) Inventor: Philip J. G. Dingle, Rochester, MI (US)

(73) Assignee: Delphi Technologies, Inc., Troy, MI (US)

( * ) Notice: Subject to any disclaimer, the term of this patent is extended or adjusted under 35 U.S.C. 154(b) by 108 days.

(21) Appl. No.: 11/998,465

(22) Filed: Nov. 29, 2007

(65) Prior Publication Data

US 2009/0139487 A1 Jun. 4, 2009

(51) Int. Cl.
*F02B 5/00* (2006.01)
*F02B 3/00* (2006.01)

(52) U.S. Cl. ..... 123/299; 123/305; 123/276; 239/533.3

(58) Field of Classification Search ..... 123/276, 123/299, 305, 300
See application file for complete search history.

(56) References Cited

U.S. PATENT DOCUMENTS 4,202,500 A * 5/1980 Keiczek ..... 239/533.3
4,528,951 A 7/1985 Yamada
5,103,776 A 4/1992 Sato
5,458,292 A * 10/1995 Hapeman ..... 239/533.4
5,626,115 A 5/1997 Kawaguchi
6,340,121 B1 * 1/2002 Lambert ..... 239/533.4
6,557,779 B2 * 5/2003 Perr et al. ..... 239/96
6,601,566 B2 * 8/2003 Gillis et al. ..... 123/468
6,705,543 B2 * 3/2004 Carroll et al. ..... 239/96
6,769,634 B2 * 8/2004 Brenk et al. ..... 239/533.3
6,769,635 B2 * 8/2004 Stewart et al. ..... 239/558
6,843,434 B2 * 1/2005 Lawrence et al. ..... 239/533.2
6,886,762 B2 * 5/2005 Angelino et al. ..... 239/596
6,918,377 B2 * 7/2005 Boltz ..... 123/467
6,945,475 B2 * 9/2005 Lawrence et al. ..... 239/533.2
7,040,279 B2 5/2006 Regueiro (Continued)

FOREIGN PATENT DOCUMENTS

EP 0464497 6/1991

(Continued)

OTHER PUBLICATIONS

European Search Report Dated Mar. 9, 2009.

(Continued)

*Primary Examiner*—Thomas N Moulis
(74) *Attorney, Agent, or Firm*—Thomas N. Twomey

(57) ABSTRACT

A fuel injection apparatus for a fuel injector nozzle includes a moveable valve needle slideably located within a nozzle body, the nozzle body having an internal surface defining a valve seat between a fuel supply path and fuel outlets. The valve needle includes an obturator piston that is engagable with an axial fuel outlet and a two-stage lift mechanism for enabling lift of the valve needle. In a first stage lifted position of the valve needle, the valve face is spaced apart from the valve seat, and the obturator piston is positioned such that a fuel flow passage is opened between the obturator piston and the axial fuel outlet. In a second stage lifted position, the valve face is spaced further apart from the valve seat and the obturator piston is positioned such that the fuel flow passage between the obturator piston and the axial fuel outlet is substantially closed.

23 Claims, 11 Drawing Sheets

U.S. PATENT DOCUMENTS

| | | | | |
|---|---|---|---|---|
| 2004/0055559 | A1 * | 3/2004 | Best | 123/276 |
| 2004/0108394 | A1 | 6/2004 | Lawrence et al. | |

FOREIGN PATENT DOCUMENTS

| | | |
|---|---|---|
| EP | 1380750 | 6/2000 |
| EP | 1693562 | 1/2005 |
| GB | 2084249 | 4/1982 |
| JP | 59145361 | 8/1984 |
| JP | 10299613 | 11/1998 |
| WO | 0233248 | 4/2002 |
| WO | WO 2006/077472 | 7/2006 |

OTHER PUBLICATIONS

Deer 2007 "Adaptive Injection Strategies for Ultra-Low Emissions Diesel Engines" Detroit, Michigan, p. 166.

SAE 100, 2005-01-0148, "The Use of Variable Geometry Sprays with Low Pressure Injection for Optimization of Diesel HCCI Engine Combustion", Y. Ra and R.D. Reitz, Engine Research Center, University of Wisconsin-Madison.

SAE 2003-01-0745, "HCCI Combustion in DI Diesel Engine", Ryo Hasegawa, Toyota Motor Corp. and Hiromichi Yanagihara, Toyota Motor Engineering & Manufacturing Europe S.A., Engine Research Center, University of Wisconsin-Madison.

851584 "Dual Fuel Injector for Diesel Engines", Shinichi Goto and Kazuo Kontani, Mechanical Engineering Laborator MITI Japan, pp. 43-47.

* cited by examiner

DUAL MODE COMBUSTION APPARATUS AND METHOD

The present invention relates to apparatus to facilitate dual mode combustion within a compression ignition internal combustion engine and a method of operating a dual combustion mode fuel injection apparatus. The apparatus comprises a nozzle arrangement for a fuel injector, particularly for a diesel internal combustion engine, that can independently deliver a fuel spray suited to a conventional, or diffusion, combustion mode and a fuel spray suited to a premixed combustion mode, typically a Homogeneous Charge Compression Ignition (HCCI) combustion mode or alternatively a Partially Premixed Compression Ignition (PPCI) mode, a Premixed Charge Compression Ignition (PCCI) mode or a Controlled Auto-ignition (CAI) mode. In particular, the present invention relates to a fuel injector nozzle arrangement, for use with a dual pressure fuel supply, for example a fuel supply delivered by an Electronic Unit Injector (EUI) or an Electronic Unit Pump (EUP) injection system, that can deliver fuel for diffusion combustion through one or more radial fuel outlets, i.e. spray holes that are angularly offset from the longitudinal axis of the fuel injector and/or cylinder, and that can deliver fuel for pre-mixed combustion through an axial fuel outlet, i.e. a spray hole that is angularly aligned with the longitudinal axis of the fuel injector and/or cylinder. The apparatus also comprises a compression ignition engine architecture having a dual combustion chamber. In particular, a combustion chamber provided with an air cell located in the crown of an engine piston.

In order to meet the requirements set by future legislation pertaining to diesel vehicle emissions it is widely proposed to use premixed combustion mode engines. However, operation in a premixed combustion mode is currently only suitable for light to moderate engine loads. For high engine loads a diffusion combustion mode must be used. The requirements for the sprays of injected fuel in premixed and diffusion combustion modes are different. For a diffusion combustion mode during which the piston is at or near Top Dead Centre (TDC) at the time when fuel is injected into the cylinder it is desired to have a highly penetrating spray that directs the injected fuel towards the walls of the cylinder, through the dense gas in the piston bowl, as quickly as possible. This requires that the fuel is injected at a relatively high pressure. For a pre-mixed combustion mode during which the piston is spaced away from TDC at the time when fuel is injected into the cylinder it is generally desired to have a low penetration spray that directs the injected fuel along the axis of the cylinder with good atomisation. This requires that the fuel is injected at a relatively low pressure to avoid impingement of fuel at the piston surface since, for such early injections, the air density in the cylinder is relatively low.

The architecture of engines and the economics of Fuel Injection Equipment (FIE) production render the provision of 2 injectors per cylinder impractical for automotive engines. Therefore, if both premixed and diffusion combustion modes are to be used in an engine there is a need for a single fuel injector nozzle that is able to provide types of spray suitable for both combustion modes, and can provide those two sprays independently. There is also a need for a switching mechanism which can efficiently facilitate injection of a fuel spray suitable for a premixed combustion mode and/or a fuel spray suitable for a diffusion combustion mode.

Fuel injectors which can inject pressurised fuel in two discrete patterns are known in the art. Examples of these types of injectors are described in WO2006/077472 and US 2004/0108394.

In WO2006/077472 and US 2004/0108394 the spray pattern for the fuel injection is selected by supplying fuel to the fuel injector at pre-determined pressures. The accurate provision of fuel at such pre-determined pressures is difficult to achieve due to inconsistencies in operation of the fuel supply apparatus. Variations in fuel pressure may affect the operation of the fuel injector and the production of the spray patterns, for example a pressure in excess of the pre-determined pressure would increase the amount by which a valve needle is raised and a fuel path is consequently opened, with potentially deleterious effects in regard to compliance with vehicle emission legislation. Consequently, there is a need for a fuel injector with a valve mechanism that can provide accurate and repeatable fuel spray patterns suitable for diffusion and/or pre-mixed combustion modes across a wider range of fuel pressures than has previously been possible.

In contemporary fuel injection systems, the ability to vary the injection pressure as desired for each speed and load is a valuable calibration variable in the quest to optimize exhaust emissions or other engine operating characteristic. For conventional diesel engine injection systems in which the atomizing nozzle needle valve is of the differential area type having a single stage lift, then once the opening pressure has been exceeded, the valve will move to its immutable full lift stop and remain there for the duration of the injection event irrespective of the injection pressure history throughout that event. This stability of valve lift helps to provide consistent performance from the system even while other parameters such as injection pressure may change.

According to a first aspect of the present invention there is provided a fuel injection apparatus for an internal combustion engine comprising, a fuel injector nozzle provided with a plurality of radial fuel outlets and an axial fuel outlet, wherein each of the fuel outlets passes through the nozzle body of the fuel injector nozzle from an internal surface to an external surface, a moveable valve needle slideably located within the nozzle body, the valve needle comprising a valve face which engages with a valve seat provided on the internal surface of the nozzle body when the valve needle is in a seated position, such that a fluid-tight seal is formed between a fuel supply path and the fuel outlets, the valve needle further comprising an obturator piston which is engageable with the axial fuel outlet, and a two-stage lift mechanism for enabling lift of the valve needle, wherein, in a first stage lifted position of the valve needle the valve face is spaced apart from the valve seat and the obturator piston is located such that a fuel flow passage is opened between the obturator piston and the axial spray hole, and in a second stage lifted position the valve face is spaced further apart from the valve seat and the obturator piston is located such that the fuel flow passage between the obturator piston and the axial spray hole is substantially closed.

When the valve needle is in the first stage lifted position and the obturator piston is not engaged with the axial fuel outlet the rate of flow of fuel through the axial fuel outlet is greater than is possible when the valve needle is in the second stage lifted position and the obturator piston is at least partially engaged with the axial fuel outlet.

The entry to each radial fuel outlet may be located on the valve seat such that when the valve needle is in the seated position the valve face covers the entry of each radial fuel outlet. The use of such a Valve Covers Orifice (VCO) arrangement is advantageous because, in the lengthy interval between injection events, fuel that remains in the fuel outlets after an injection event is less likely to be drawn into the cylinder due to air motion within the engine cylinder. Any such fuel that is blown out will appear as undesirable HC emissions in the exhaust stream.

The valve needle may further comprise a spray shaping region having, at least in part, a concave, necked profile, wherein, in use, the profile of the spray shaping region encourages fuel passing the surface of the valve needle to be attached to it.

The concave, necked profile may be located between the valve seat and the obturator piston, and the profile of the valve needle may transition smoothly between the valve seat, spray shaping region and obturator piston.

It is advantageous to encourage fuel injected through the axial fuel outlet to attach itself to the valve needle as it passes it, at least in the spray shaping region described above, as this increases the proportion of fuel injected through the axial fuel outlet and thus reduces the proportion of fuel injected through the radial fuel outlets. The axial fuel outlet is opened when it is desired to provide an injection of fuel for a premixed combustion mode. During a premixed combustion mode it is desirable to maximise the amount of fuel injected through the axial fuel outlet because the spray passing from the axial fuel outlet is directed downwardly, i.e. along the longitudinal axis of the cylinder away from the cylinder walls. It is desirable to minimise the amount of fuel injected through the radial fuel outlets during a premixed combustion mode because there is a higher risk that fuel introduced in a direction that is angularly offset from the longitudinal axis of the fuel injector and/or cylinder will impinge upon the cylinder walls resulting in the above-described problems inherent therewith. If the form of the lower part of the valve needle were to be discontinuous this would discourage the fuel from attaching itself to the valve needle. As such, the path of least resistance would no longer be along the surface of the valve needle with the result that this would cause the fuel to seek other low resistance fuel paths, one of which may be via the radial fuel outlets, which for the previously described reasons is undesirable.

When the valve needle is in the first stage lifted position there may be an annular volume around the valve needle tip, wherein, in use, fuel flows through the volume and across the obturator piston.

The obturator piston may be a close fit within the axial fuel outlet such that, in use, when the valve needle is in the second stage lifted position, fuel flow past the obturator piston is minimised. The valve needle is lifted to a second stage position when it is desired to inject fuel for a diffusion combustion mode through the radial fuel outlets. In this position it may be advantageous to minimise the flow of leaked fuel between the external surface of the obturator piston and the internal surface of the axial fuel outlet as any such fuel may not be injected in an optimised form, for example it might be poorly atomised, and this would result in unacceptable levels of particulates in the exhaust gases. Fuel leakage from the axial fuel outlet is expected due to the sliding arrangement between the obturator piston and the walls of the axial fuel outlet that demands some clearance between the obturator piston and the axial fuel outlet.

Alternatively, there may be a clearance between the external profile of the obturator piston and the internal profile of the axial fuel outlet such that, in use, when the valve needle is in the second stage lifted position an optimised fuel flow past the obturator piston is obtained.

Although in most circumstances the leakage of fuel through the axial fuel outlet should be minimised it is envisaged that a leakage may be desirable. This would depend upon the design of the internal combustion engine and in particular the combustion chamber. If the engine is able to utilise fuel emitted from the axial spray hole during a diffusion combustion mode to enhance the efficiency of combustion, for example by re-energising late-stage combustion then it can be seen that some leakage would be desirable.

The valve needle may further comprise around the periphery of its lower end a balancing groove, which, in use acts to centralise the valve needle within the nozzle body. It is advantageous to maintain the valve needle centrally within the nozzle body for uniform injection through the radial and axial fuel outlets. In addition to the described balancing groove any suitable form of needle centralisation means may be used. For example, the valve seat may incorporate features to promote centralisation.

The body of the fuel injection nozzle may further comprise a reinforcing ring around the axial fuel outlet. The axial fuel outlet through the centre of the nozzle body causes the hoop stresses in the nozzle body to be very high. It is disadvantageous to have high hoop stresses as the properties of the material of the nozzle body limit the pressure of the fuel that can be injected through the nozzle. The inclusion of the strengthening ring adds strength to the tip of the nozzle body and hence reduces the hoop stresses. This allows the fuel injector to operate with higher fuel pressures.

The diameter of the reinforcing ring may increase towards its lower end. This is advantageous because it enables a cone shaped spray to be injected from the axial fuel outlet without that spray impinging on the reinforcing ring.

The fuel injection apparatus may further comprise a fuel supply mechanism which, in use, can supply pressurised fuel to the nozzle body within two discrete ranges of pressure.

As recited previously, during premixed combustion modes, a premixed charge is desired which may be created through one or more early injections delivered during the compression stroke. However, since the charge density in the cylinder is low at this time, a highly penetrating spray is not desired and thus a relatively low injection pressure is appropriate for the first stage of nozzle valve lift. For diffusion combustion, a late injection event or events) is normally timed to occur close to piston TDC at which time, charge density will be high, thus high injection pressures are required for the second stage of valve lift so that adequate fuel dispersion and mixing may be obtained.

The fuel supply mechanism may be an electronic unit pump of the so-called two-valve type. Alternatively, a hybrid system may be utilised. Such a system has an accumulator volume such as a common rail which can supply fuel at a relatively low pressure, e.g. 800 bar and a unit injector which can increase the fuel supply pressure to a relatively high pressure, e.g. 2,500 bar.

An electronic unit pump can control the pressure of fuel supplied to the fuel injector on a shot-by-shot basis. However, it is advantageous to use a hybrid system because the control of fuel pressure is more precise. The relatively low pressure required for fuel injection during a premixed combustion mode, must be closely controlled as the fuel pressure must fall within a range of, for example, 300-900 bar if the valve needle is to be at the first stage lifted position. The fuel can be supplied by an EUI, but it is best supplied from the rail at a more constant value which facilitates calibration of the fuel injection equipment. The need for close control of the fuel pressure of the supply of relatively high pressure fuel to lift the valve needle to a second stage lifted position is lower because any fuel pressure in excess of the 900 bar threshold will move the valve needle to the second stage lifted position.

The two-stage lift mechanism may comprise a first resilient element and a second resilient element arranged in parallel and acting downwardly upon the valve needle wherein, in use, to lift the valve needle to the first stage lifted position an upwardly acting force in excess of the preload of the first resilient element needs to be applied to the valve needle and to lift the valve needle to the second stage lifted position an upwardly acting force in excess of the spring force of the first resilient element and the preload of the second resilient element needs to be applied to the valve needle.

The advantage of a two-stage lift mechanism is that it enables the valve needle to be accurately maintained at a first stage lifted position and a second lifted position without being sensitive to fluctuations in pressure that would otherwise change the position of the valve needle. Any variations in fuel pressure that do occur have a smaller impact on the combustion than would variations in the valve needle position.

Alternatively, the valve needle may be provided around its periphery at its lower end with a plurality of recessed areas, such that, in use, the fuel injected from the axial fuel outlet has a multi-jet pattern. Typically there might be four recessed areas, equally spaced around the periphery of the valve needle. However, different numbers of recessed areas and different spacing patterns are envisaged. The provision of recessed areas, typically in the form of flats, concentrates the fuel spray and increases the penetration of the fuel into the cylinder. In addition the provision of recessed areas can be used as a means of optimising the flow between the axial fuel outlet and the obturator piston when the valve needle is in the second stage lifted position, i.e. when the obturator piston is withdrawn into the axial fuel outlet. Optimisation of the flow between the axial fuel outlet and the obturator piston may be desirable in some engine configurations in which the claimed fuel injection apparatus may be utilised. Further discussion of this can be found below.

When the valve needle is in a first stage lifted position or in a second stage lifted position the flow area of the fuel outlets may be the smallest flow area in the fuel supply path. For good flow control and atomisation the smallest and therefore the controlling flow area in a system should be the final orifice. Thus at any desired lift position the flow area at the valve seat should be greater than that at the fuel outlet orifice.

It is desirable to maximise the efficiency of the dual mode combustion and to further reduce the engine out emissions. Such effects depend, at least in part, upon the efficient burning of all the fuel injected into the engine. An example of an engine architecture aimed at efficient burning of fuel injected through a multi-spray injector is described in EP 0 464 497. However, this architecture is for an engine utilising a conventional combustion mode only. The combustion system of EP 0 464 497 is intended to utilize high quality sprays. That is to say, the sprays emanating from the fuel injector nozzle are intended to be well atomized in both modes, i.e. with the valve needle at first and second stage lifted positions), and only conventional diffusion combustion is contemplated. Therefore, there is a need for an improved engine architecture suitable for use with a dual combustion mode engine.

Accordingly, a second aspect of the present invention provides an internal combustion engine comprising a fuel injector, a fuel supply means, and a reciprocating piston, the fuel injector comprising a nozzle body provided with a plurality of radial fuel outlets and an axial fuel outlet, a moveable valve needle which allows or prevents fuel flow through the radial and axial fuel outlets, and a lift mechanism which controls movement of the valve needle under the influence of pressurised fuel provided by the fuel supply means, the reciprocating piston comprising a combustion chamber having a secondary combustion cavity provided with an inlet, wherein the inlet is arranged relative to the axial fuel outlet of the fuel injector such that, in use, when the reciprocating piston is at or near a top dead centre (TDC) position, fuel passing through the axial fuel outlet is directed into the secondary combustion cavity, characterised in that, when the fuel supply means supplies fuel to the injector at a first pressure the lift mechanism raises the valve needle to a first lifted position, wherein a first portion of the injected fuel is injected through the axial fuel outlet and in that when the fuel supply means supplies fuel to the injector at a second pressure the lift mechanism raises the valve needle to a second lifted position wherein a second portion of the injected fuel is injected through the radial fuel outlets.

In the present invention, the air cell chamber only comes into use as intended during the diffusion combustion mode when the radial sprays are well atomized and behave in a conventional manner, but the axial spray is necessarily poorly atomized since it is formed essentially by leakage through the close clearance between the obturator piston and the axial fuel outlet. Thus use of the air cell is a solution to a problem that would normally result in smoky inefficient combustion. Given the nominally good atomization in both modes from the system described in EP 0 464 497, one would not choose to use the air cell solution for the axial spray in that case. The specification of EP 0 464 497 does not describe the use of an air cell to combust poorly atomized fuel.

In diffusion diesel combustion, there is a continuous mixing of the air with the fuel as it breaks up and evaporates. To achieve this mixing, energy must be expended on either the air, or the fuel, or both. Conventionally, high momentum is given to the fuel through high injection pressure, in which case only low momentum is required from the air. However, in the past before high injection pressures were technologically possible, air cell combustion systems were common in which the mixing was derived largely from high air motion. In the present invention, there is a low injection energy in the second stage axial spray, and so it is necessary to use the air cell to obtain the required mixing through high air motion during the reflux from that chamber.

When the valve needle is in the first lifted position, the first portion of the fuel injected through the axial fuel outlet is the majority quantity of the injected fuel and the minority quantity of the injected fuel is injected through the radial fuel outlets and in that when the valve needle is in the second lifted position the second portion of the fuel injected through the radial fuel outlets is the majority quantity of the injected fuel and the minority quantity of the injected fuel is injected through the axial fuel outlet.

Through this means, a near uniform bulk fuel/air mixture is achieved in the cylinder during the first stage lift injection, and conventional diffusion combustion is obtained from the second stage needle lift spray pattern.

When the valve needle is in the first lifted position the minority quantity of fuel injected through the radial fuel outlets is minimised and when the valve needle is in the second lifted position the minority quantity of fuel injected through the axial fuel outlet is minimised.

By this means, radial penetration of fuel onto the cylinder walls is minimized during the first stage of needle lift, and the proportion of fuel that interacts with the air cell is minimized during the second stage of needle lift.

Alternatively, when the valve needle is in the $1^{st}$ lifted position the minority quantity of fuel injected through the radial fuel outlets may be optimised. In this mode, the needle lift stop determines the resultant flow area at the axial orifice formed by the obturator-to-body spacing. Reducing this gap and thus the flow area will encourage more fuel to exit the radial outlets, while increasing the gap will bias the flow to the axial outlet.

The lift mechanism may be a two-stage lift mechanism and the valve needle may be raised to a first stage position and a second stage position. The multiple stages of needle lift may be achieved through means other than the preferred embodiment described herein; the other means including but not limited to direct needle actuation (Ref: DFI-3), or through use of a hydraulic servo mechanism.

The secondary combustion cavity may be spherical. The advantage of a spherical cavity is that the sphere has the lowest surface-to-volume ratio, thus less of the heat from the compressed air in the cylinder is lost to the piston and in this way more heat remains for the evaporation and preparation of the fuel for combustion.

EP 0 464 497 discloses a secondary combustion chamber having a multiple number of holes that are necessary because a greater proportion of the delivered fuel enters the chamber, burns, and must escape. Additionally, its prime purpose is to re-energise late-stage combustion, and the other outlets are directed in a manner to do that. In an embodiment of the present invention, a single hole is used because we want to maximise the velocity of the reflux resulting from the air cell combustion of the early fuel packets to assist the break-up and combustion of the later packets of poorly atomized fuel as they traverse the widening gap between nozzle and receding piston as it moves past TDC. In the present invention the chamber entry/exit has a radiused or diverging form so that during compression, there is efficient transfer of air into the chamber, while during reflux there is some dispersion of the combustion products to assist the re-energization function and to avoid harmful impingement on the nozzle tip. However, it is envisaged that the combustion cavity may be of any suitable shape. Combustion of the secondary fuel within the air cell will cause a forceful outrush of combustion products as the piston descends and this will re-energise combustion in the otherwise inactive region in the centre of the combustion chamber.

According to a third aspect of the present invention there is provided a method of operating a dual combustion mode fuel injection system comprising the steps of: supplying fuel to a fuel injector at a first pressure such that a first injection event occurs in which a majority portion of the fuel is injected through a nozzle outlet path for a premixed combustion mode and a minority portion of the fuel is injected through a nozzle outlet path for a diffusion combustion mode; subsequently, within the same combustion cycle supplying fuel to the fuel injector at a second pressure such that a second injection event occurs in which a majority portion of the fuel is injected through a nozzle outlet path for a diffusion combustion mode and a minority portion of the fuel is injected through a nozzle outlet path for a premixed combustion mode; burning the fuel injected through the nozzle path for a diffusion combustion mode during the second injection event in a primary combustion event and burning the fuel injected through the nozzle path for a premixed combustion mode in a secondary combustion event; and re-energising the primary combustion event with the combustion gases from the secondary combustion event.

The need for re-energisation comes from the rapid decline in air motion, typically swirl, that occurs once the piston starts to descend after passing TDC. This is serious, since diffusion combustion depends upon air and fuel molecules finding each other. Most combustion occurs towards the periphery of the main chamber since that is where the spray plumes point and the air motion is highest. Reflux from the air cell will be directed into the centre of the main chamber where oxygen likely remains, and will initiate a new conflagration.

During the first injection event the secondary injection of fuel through the nozzle outlet path for a diffusion combustion mode may be minimised and during the second injection event the secondary injection of fuel through the nozzle outlet path for a premixed diffusion combustion mode may be minimised.

During the first injection event the secondary injection of fuel through the nozzle outlet path for a diffusion combustion mode may be optimised and during the second injection event the secondary injection of fuel through the nozzle outlet path for a diffusion combustion mode may be optimised.

The fuel injected in the first injection event may be at a relatively low pressure and the fuel injected in the second injection event may be at a relatively high pressure.

In the second injection event the secondary combustion event may be conducted in a separate combustion chamber and the primary combustion event may be re-energised by ejecting the combustion gases from the first combustion chamber to the second combustion chamber substantially only along the axis of the nozzle outlet path for a premixed combustion mode.

An embodiment of the present invention will now be described with reference to the accompanying drawings in which.

Figure 8:
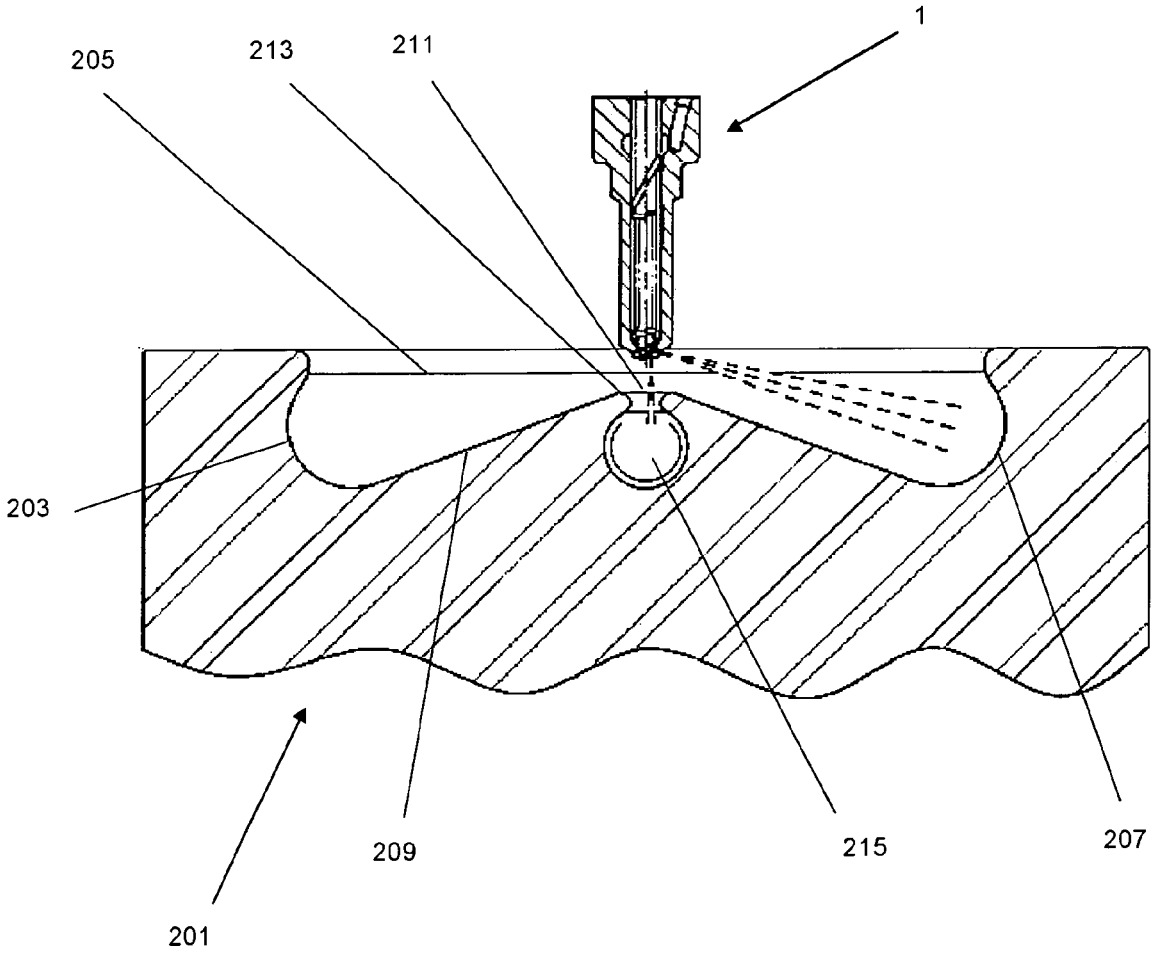
Figure 9:
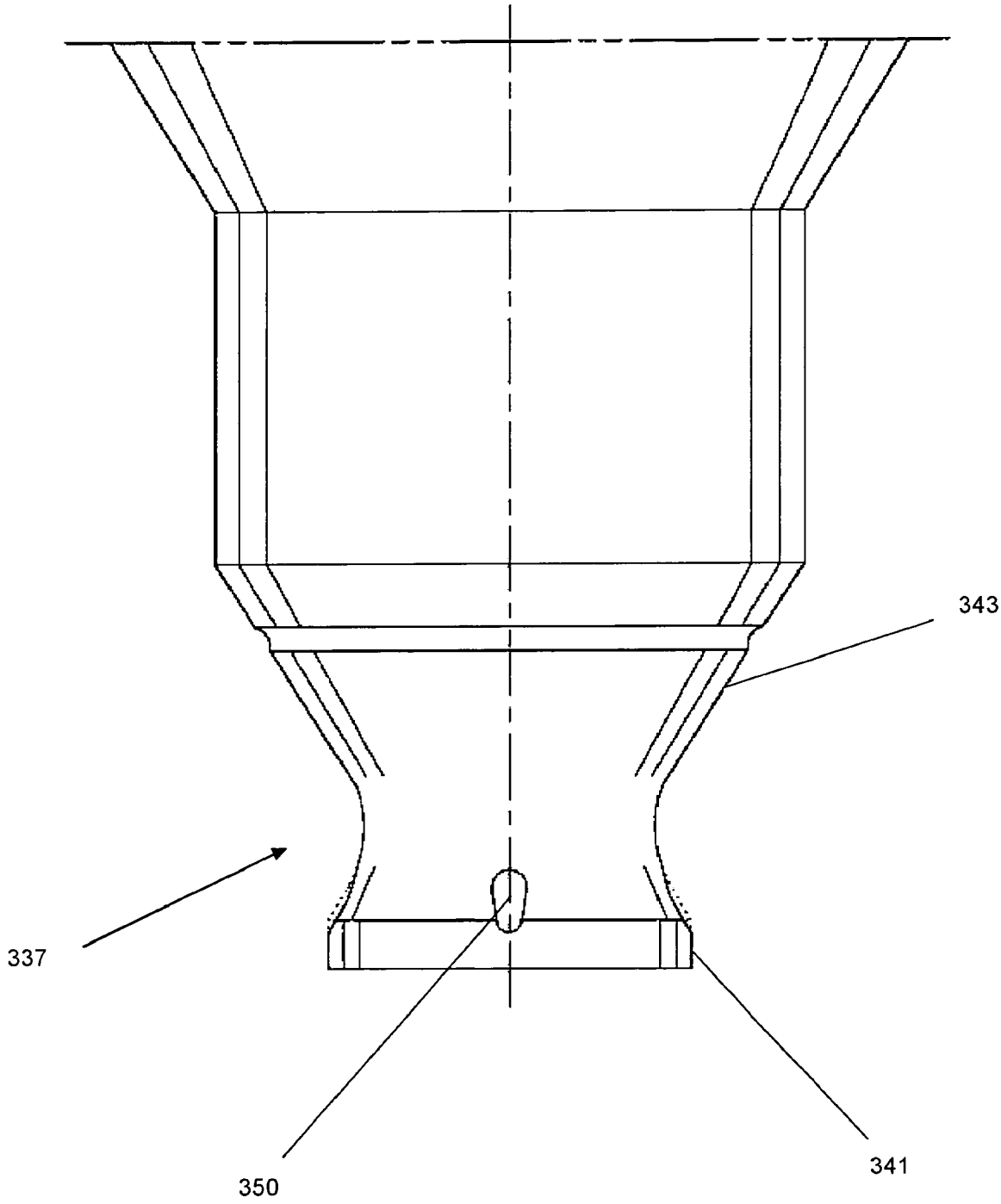
Figure 10:
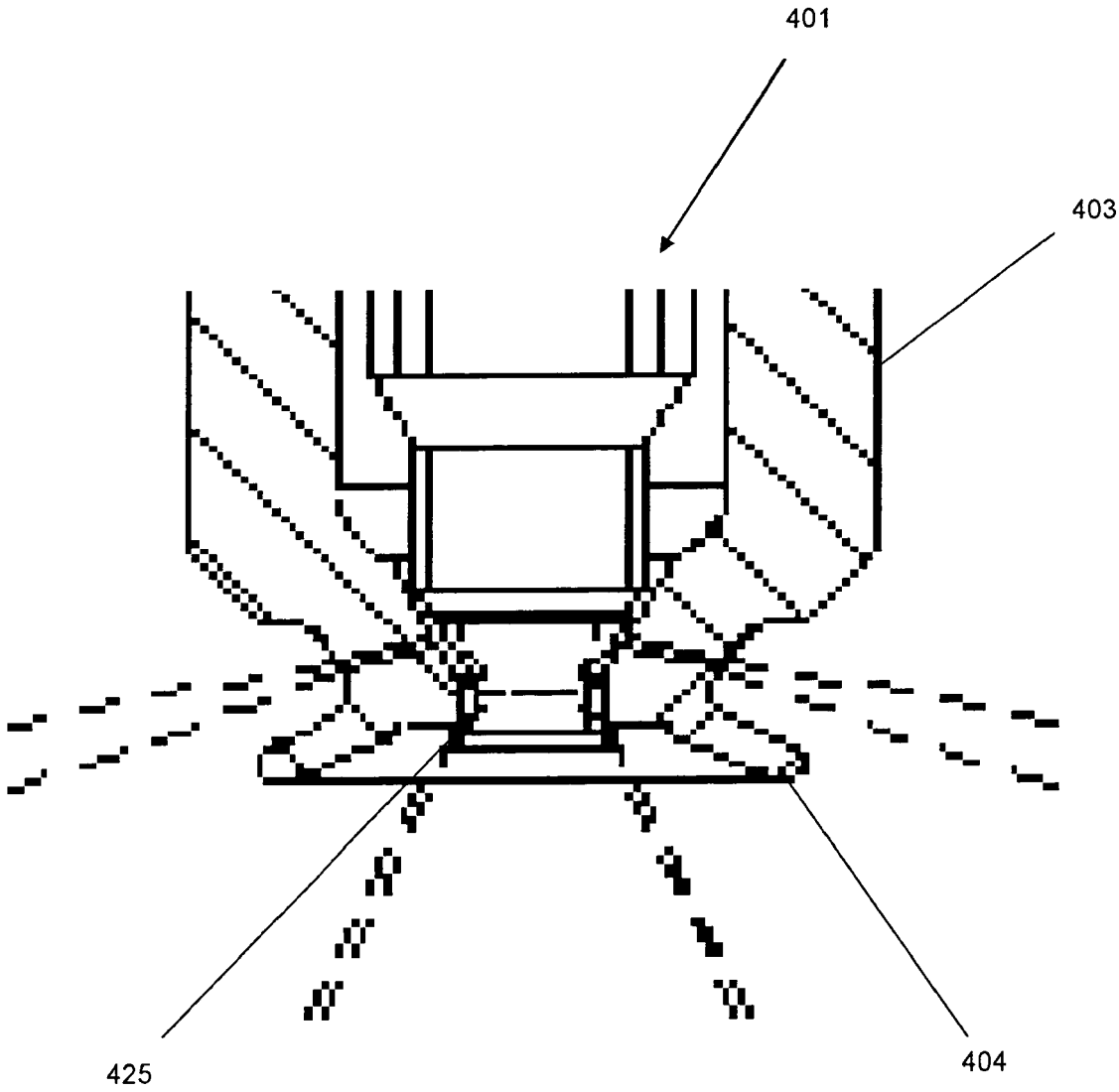
Figure 11:
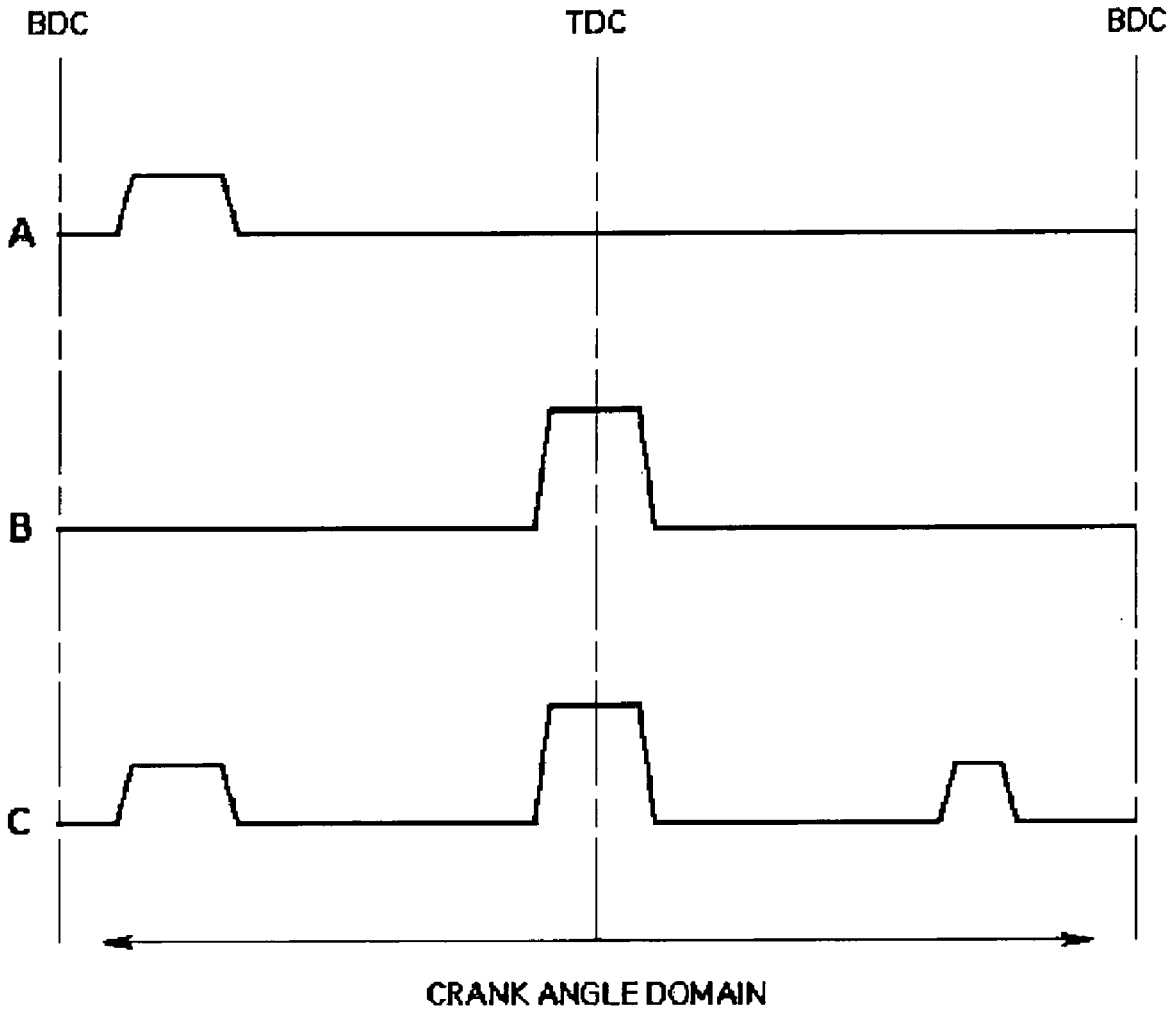

FIG. 8 is a view of an energy cell combustion system according to a further aspect of the present invention, in which the left hand side of the fuel injector shows the valve needle in a seated position, wherein no injection of fuel is being made, and the right hand side of the fuel injector shows the valve needle in a fully raised position, wherein a fuel injection is occurring in which a majority portion of the injected fuel passes through the radial spray holes and a minority portion of the injected fuel passes through the axial spray hole;

FIG. 9 is a cross-sectional elevation of an alternative embodiment of a valve needle according to the present invention in which the spray shaping region and the obturator piston are provided with a number of recesses;

FIG. 10 is an alternative design of nozzle body according to the present invention, provided with a strengthening ring at the tip, and FIG. 11 is a schematic illustration showing three discrete injection strategies, strategy A illustrates a single early premixed combustion mode injection, strategy B illustrates a single late diffusion combustion mode injection and strategy C illustrates a combined strategy in which a portion of the total fuel injected is delivered in an early premixed combustion mode injection, followed by the remainder in a late diffusion combustion mode injection, both within the same combustion cycle, strategy C also illustrates a late fuel injection in the expansion stroke, through the spray holes for a premixed combustion mode.

Figure 2:
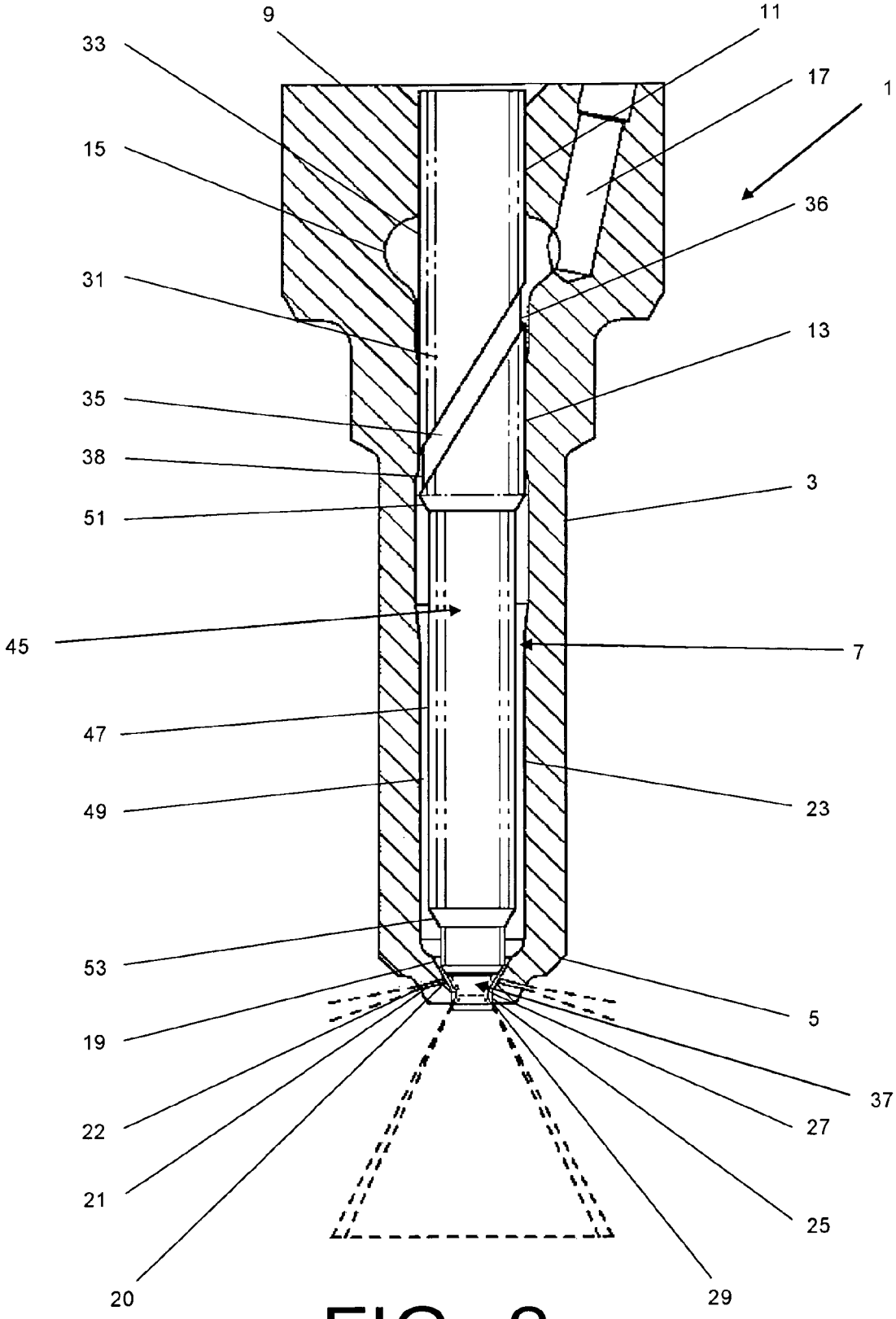
FIG. 2 is a cross-sectional elevation of a fuel injector nozzle according to the present invention.

A fuel injector nozzle 1 according to an embodiment of the present invention is illustrated in FIG. 2.

The fuel injector nozzle 1 comprises a nozzle body 3 which is elongate, generally cylindrical and hollow. The nozzle body 3 tapers at a lower end to a frustoconically shaped tip 5. In this description the downward direction is the direction along the fuel injector nozzle 1 towards the tip 5. Thus the lower end of any described component is the end located downwardly and the upper end of any described component is the end located uppermost.

Within the nozzle body 3 there is provided a co-axially aligned circular cross-section nozzle bore 7. The bore 7 passes along the entire length of the nozzle body 3, from the tip 5 to an upper mating face 9 and is open at both ends. The bore 7 has along its length five discrete portions.

In the upper half of the bore 7 there is an upper valve needle guide portion 11 and a lower valve needle guide portion 13. An annular fuel recess 15 is provided around the bore 7 between the guide portions 11, 13. Pressurised fuel is supplied into this recess 15 via a passageway 17 which passes from the mating face 9 through the nozzle body 3 to the recess 15.

At the other end of the bore 7, within the tip 5, there is provided a frustoconical valve seat 19 and a row of radially equally spaced cylindrical upper spray holes 21 which pass through the wall of the nozzle body 3. The spray holes 21 each have a hole entry 20 located on the valve seat 19 and a hole exit 22 located on the external surface of the nozzle body 3. The longitudinal axis of each spray hole 21 is located at a downwardly directed obtuse angle, relative to the longitudinal axis of the nozzle body 3, so that the fuel passing through the spray holes 21 has a relatively large radial component of velocity.

In between the valve seat 19 and the guide portion 13 there is a cylindrical bore 23.

Figure 3:
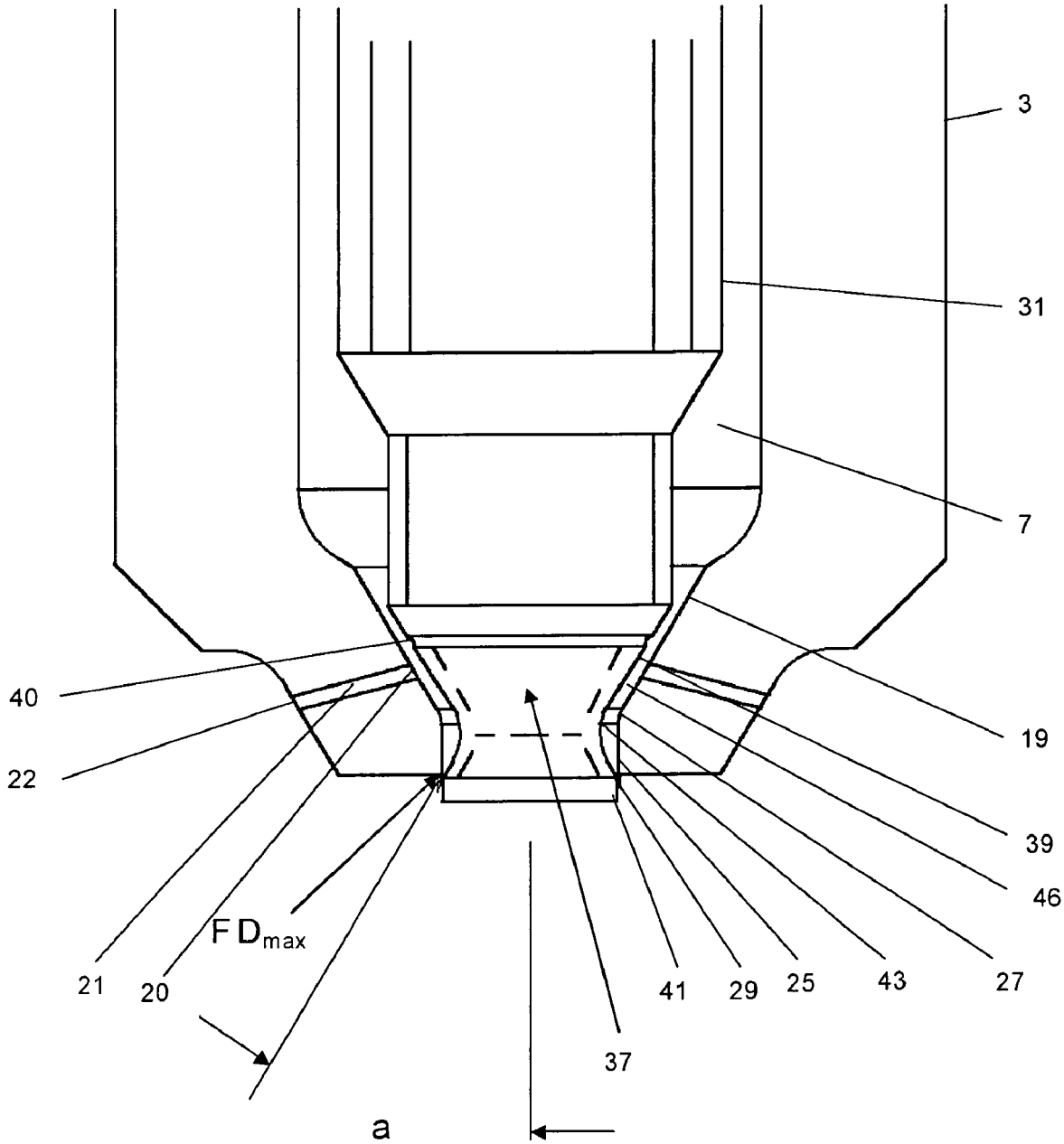
FIG. 3 is an enlarged cross-sectional elevation of the lower part of the fuel injector nozzle of FIG. 2.

At the lower end of the bore 7 there is provided a cylindrical axial spray hole 25 which is aligned with the longitudinal axis of the bore 7. The spray hole 25 has a hole entry 27 located at the lower end of the valve seat 19 and a hole exit 29 on the external surface of the tip 5. This is also shown in FIG. 3.

Located within the bore 7 there is a valve needle 31 having a circular cross-sectional profile. The valve needle 31 is co-axially aligned with the bore 7 and, extends from the mating face 9 to the spray hole exit 29. FIG. 3 shows a truncated view of the needle 31. In full form it extends outside of the nozzle body 3, above the mating face 9. An equivalent of the valve needle 31 can be seen in FIG. 1, where it is shown mating with a two-stage valve lift mechanism 71, described in detail below.

The valve needle 31 has along its length three discrete portions.

On its upper half the valve needle 31 is provided with a guide portion 33. The guide portion 33 has an external diameter that is just smaller than the internal diameter of the guide portions 11,13 such that the valve needle 31 can slide relative to the bore 7 whilst being guided by it.

The guide portion 33 is provided with an axially diagonal groove 35 which passes around the circumference of the valve needle 31 and is located such that, in operation, fuel can flow from the recess 15 into the bore 23.

At the lower end of the valve needle 31, there is a valve needle tip 37 comprising a frusto-conical valve member 39 which is of complementary shape to the valve seat 19 provided in the bore 7, so that when the valve member 39 is rested against the valve seat 19 a fluid-tight seal is created. The dimensions of the valve member 39 are chosen such that when it rests on the valve seat 19 it covers the hole entries 20 of the spray holes 21.

The valve member 39 also comprises an annular needle centralisation groove 40 around its perimeter and perpendicular to the longitudinal axis of the valve needle 31. When the valve needle 31 is located against the valve seat 19 the groove 40 overlaps an upper portion of each spray hole entry 20.

At its lowest extremity the valve needle tip 37 comprises an obturator piston 41 which has a diameter slightly smaller than that of the axial spray hole 25, such that it can slide relative to the axial spray hole 25 whilst leakage across the obturator piston 41 is minimised.

Between the valve member 39 and the obturator piston 41 there is a pintle region comprising an inwardly curved spray shaping region 43. The shape of the region 43 is chosen to give the desired cross-section to the diverging cone fuel spray passing through axial spray hole 25, when the valve needle 31 is lifted from the valve seat 19. The maximum diameter, Dmax, of the region 43 is no more than the 1.5 mm of the obturator piston 41 and the divergent angle, $\alpha$, is the same or slightly greater than that of the desired narrow cone spray.

Figure 5:
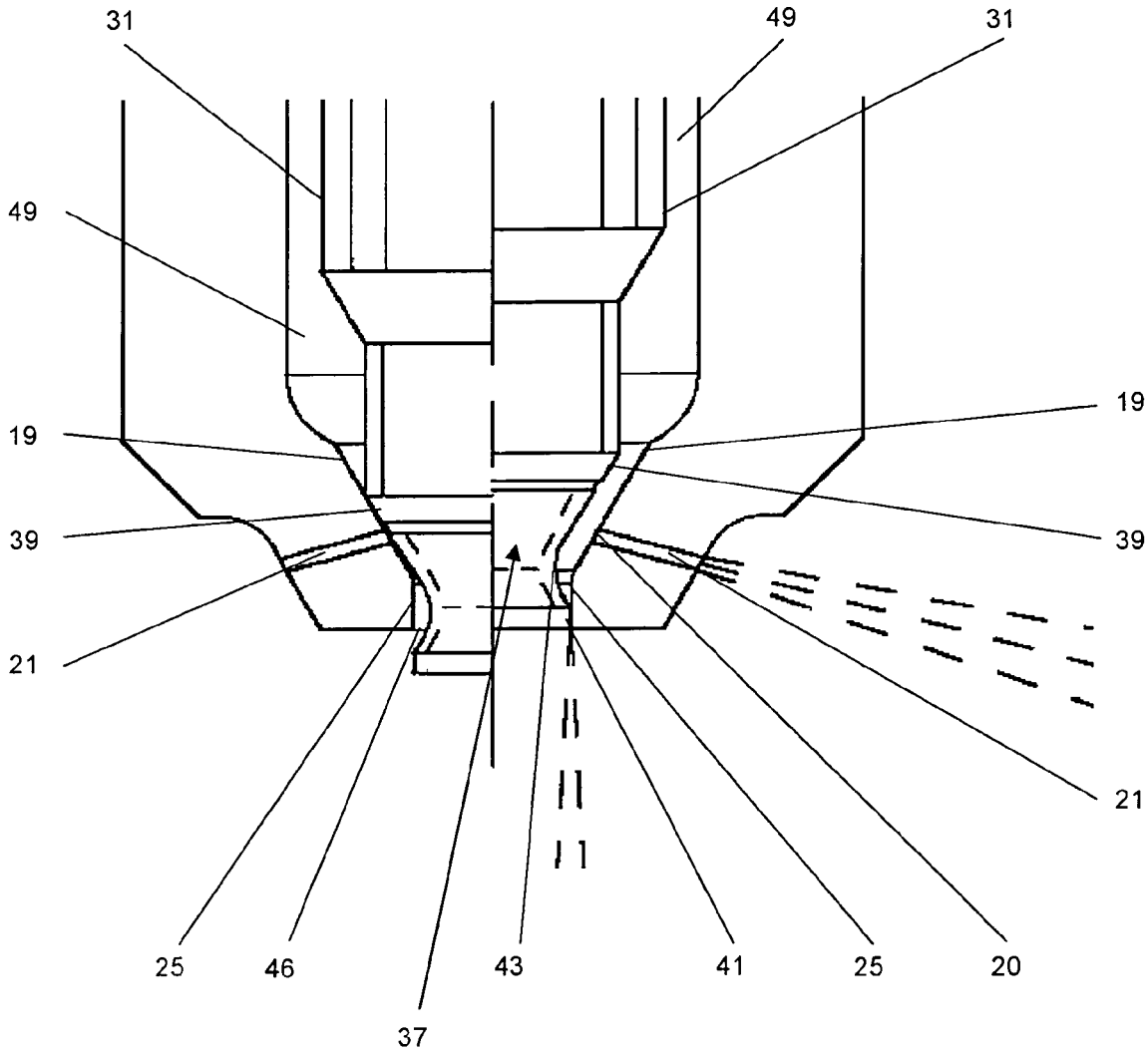
FIG. 5 is an enlarged view of the lower part of the fuel injector nozzle of FIG. 2, showing on the left hand side the valve needle in a fully lowered, seated, position and on the right hand side the valve needle in a fully raised position.

The dimensions of the valve needle tip 37 are chosen such that when the valve needle 31 is in its lowest position and the valve member 39 is seated on the valve seat 19, the obturator piston 41 is located externally to the nozzle body 3, as shown in the left hand side of FIG. 5. This creates an annular volume 46 between region 43 of the pintle obturator 37 and the walls of the axial spray hole 25, which when the valve needle 37 is lifted from the valve seat 19 acts as a fuel flow passage.

This flow through the annular volume 46 results in a hollow cone spray profile being produced from the axial spray hole 25 when the valve needle 31 is lifted from the valve seat 19.

There is also an annular volume between the valve seat 19 and the valve face 39.

Between the valve needle tip 37 and the guide portion 33, the valve needle 31 has an intermediate portion 45 with three discrete portions.

There is a central cylindrical section 47 of smaller external diameter than the internal diameter of the bore 23, such that an annular space, referred to as fuel delivery chamber 49, is created between the valve needle 31 and the bore 7. At an upper and lower end of the central cylindrical section 47 are frustoconical thrust surfaces 51, 53.

This arrangement enables the needle 31 to take up three positions within the bore 7.

In a first position, as shown on the left hand side of FIG. 5, the valve needle 31 is fully lowered and the valve member 39 is located against the valve seat 19. In this position the flow path from the fuel delivery chamber 49 to the valve seat 19 is closed and hence no injection can occur through either the radial spray holes 21 or the axial spray hole 25.

Figure 4:
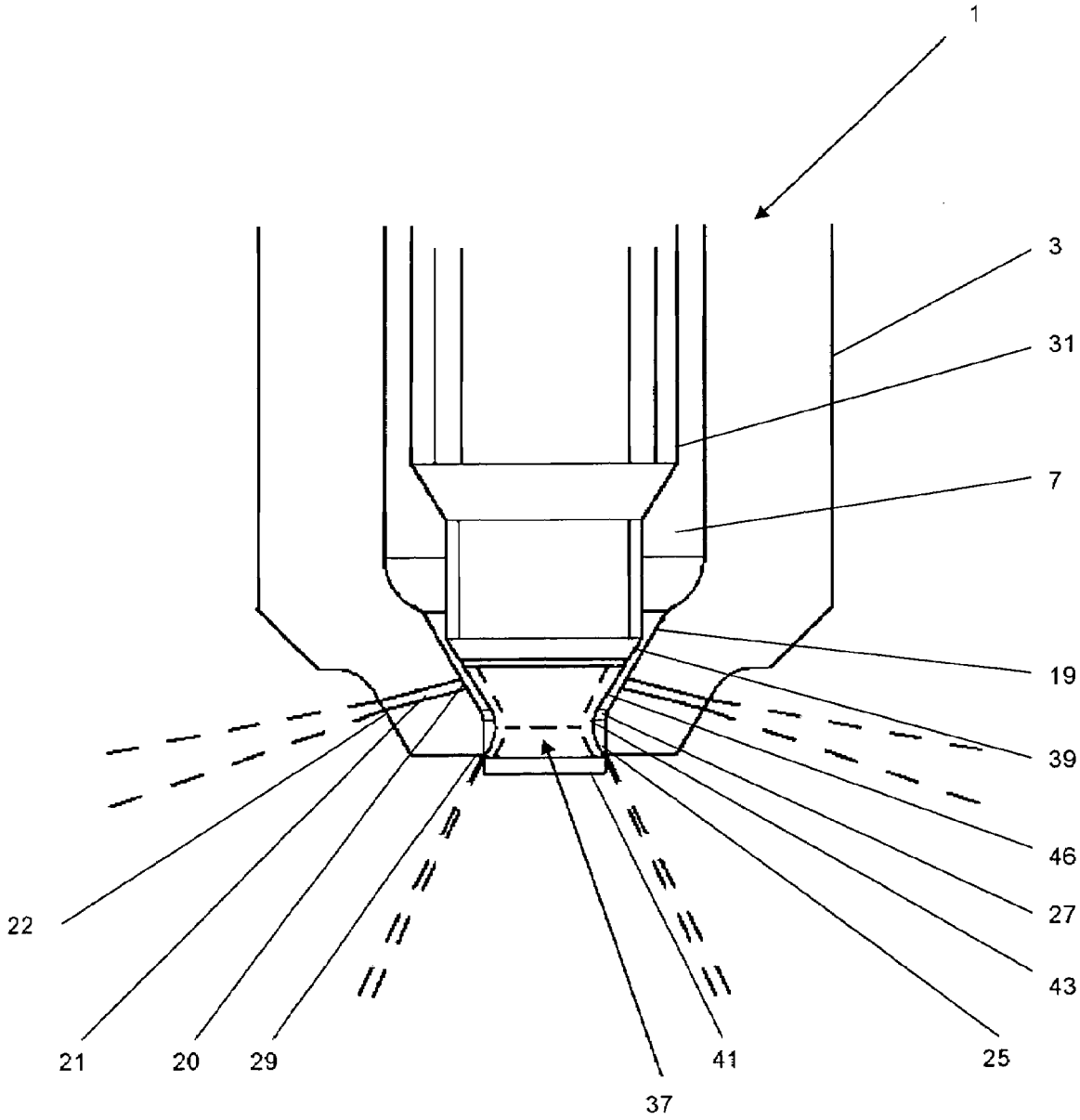
FIG. 4 is an enlarged cross-sectional elevation of the lower part of the fuel injector nozzle of FIG. 2, showing the valve needle in a $1^{st}$ stage raised position such that an injection event is occurring through an upper row of radial spray holes and through an axial spray hole in which the majority of the injected fuel flows through the radial spray holes.

In a second, intermediate, position, shown in FIGS. 2, 3 and 4, the valve needle 31 is only partially lifted. The valve member 39 is still raised away from the valve seat 19 and a flow path is open between the fuel delivery chamber 49 and the axial spray hole 25 and the radial spray holes 21. An injection event occurs through the axial spray holes 25, because the obturator piston 41 is not fully withdrawn into the nozzle body and a flow path is created from the delivery chamber 49 to the axial spray hole entry 27. The degree by which the piston obturator 41 extends outside of the spray hole 25, in combination with the form of the valve needle tip 37, in particular the curved spray shaping region 43, determines the included angle of the hollow cone spray exiting the spray hole 25. The primary influence on the included angle of the hollow cone spray emanating from the clearance is the diverging profile between the region 43 and the piston 41. This feature is a calibration variable used in matching the spray cone to the combustion system. In addition to the primary injection of fuel through the axial spray hole 25 a small amount of fuel may be injected through the radial spray holes 21.

In the second position a desired fuel flow rate through the axial spray hole 25 can be obtained, controlled by the position of the obturator piston 41, without there being an undue restriction across the valve seat 19. Furthermore, since the flow rate is determined by the size of the flow paths through the radial and axial spray holes 21,25, and not by valve seat throttling it should be possible to obtain good atomisation.

In a third position, shown on the right hand side of FIG. 5, the valve needle 31 is fully lifted and the valve member 39 is raised away from the valve seat 19. In this position a flow path is created between the fuel delivery chamber 49 and the spray hole entries 20. Thus when the valve needle 31 is in this position a fuel injection event through the spray holes 21 takes place. A flow path is also opened up to the curved spray shaping region 43 of the valve needle tip 37. However, because the lift of the valve needle 31 is sufficient to draw the obturator piston 41 fully within the axial spray hole 25 a full fuel injection event across the valve needle tip 37 is not possible. As a result of the diametral clearance between the obturator piston 41 and the spray hole 25 some fuel is injected, as shown on the right hand side of FIG. 5.

Figure 1:
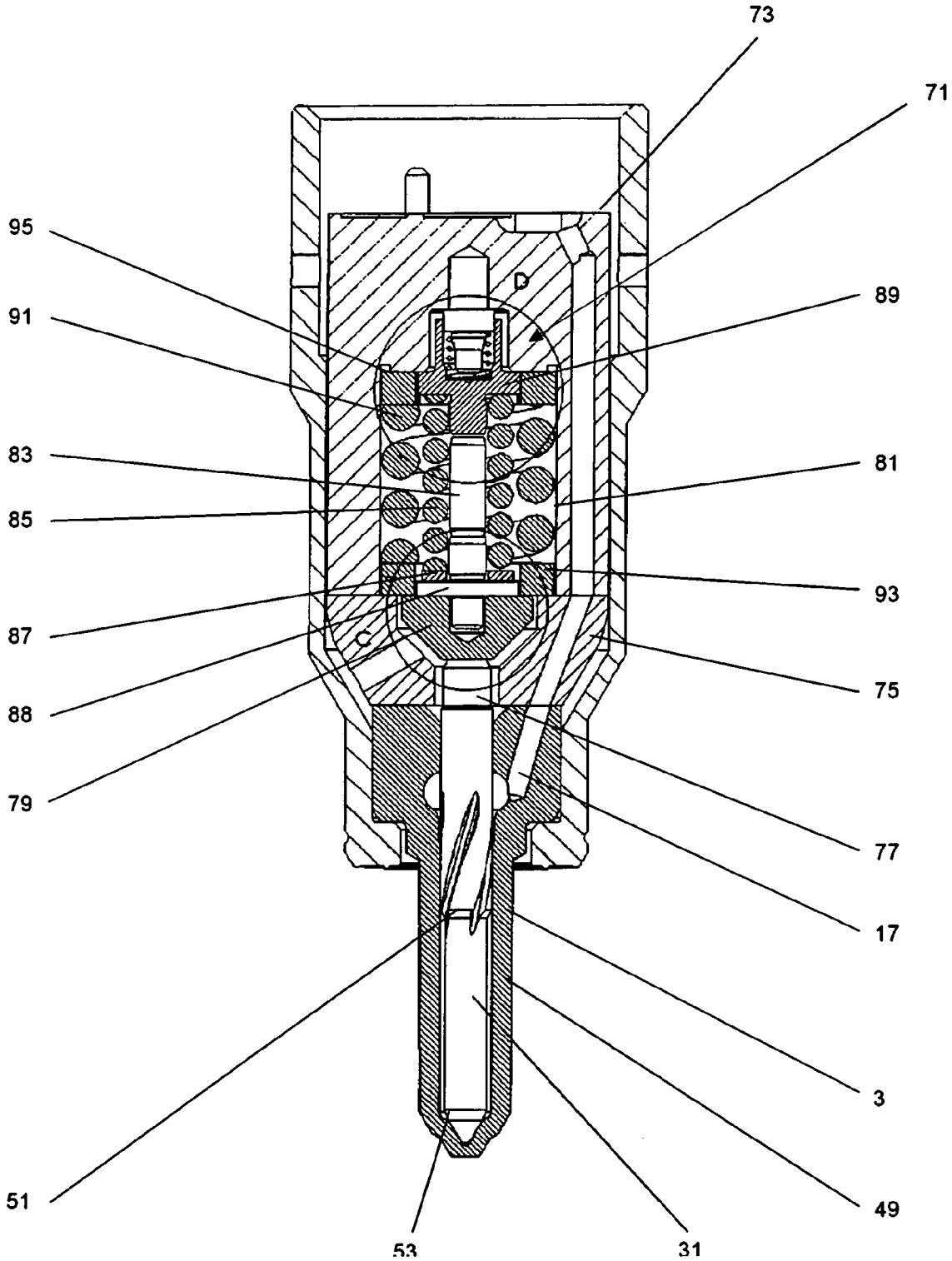
FIG. 1 is a cross-sectional elevation of a prior art fuel injection nozzle assembly from an EUI having a two-stage valve needle lift mechanism.
Figure 6:
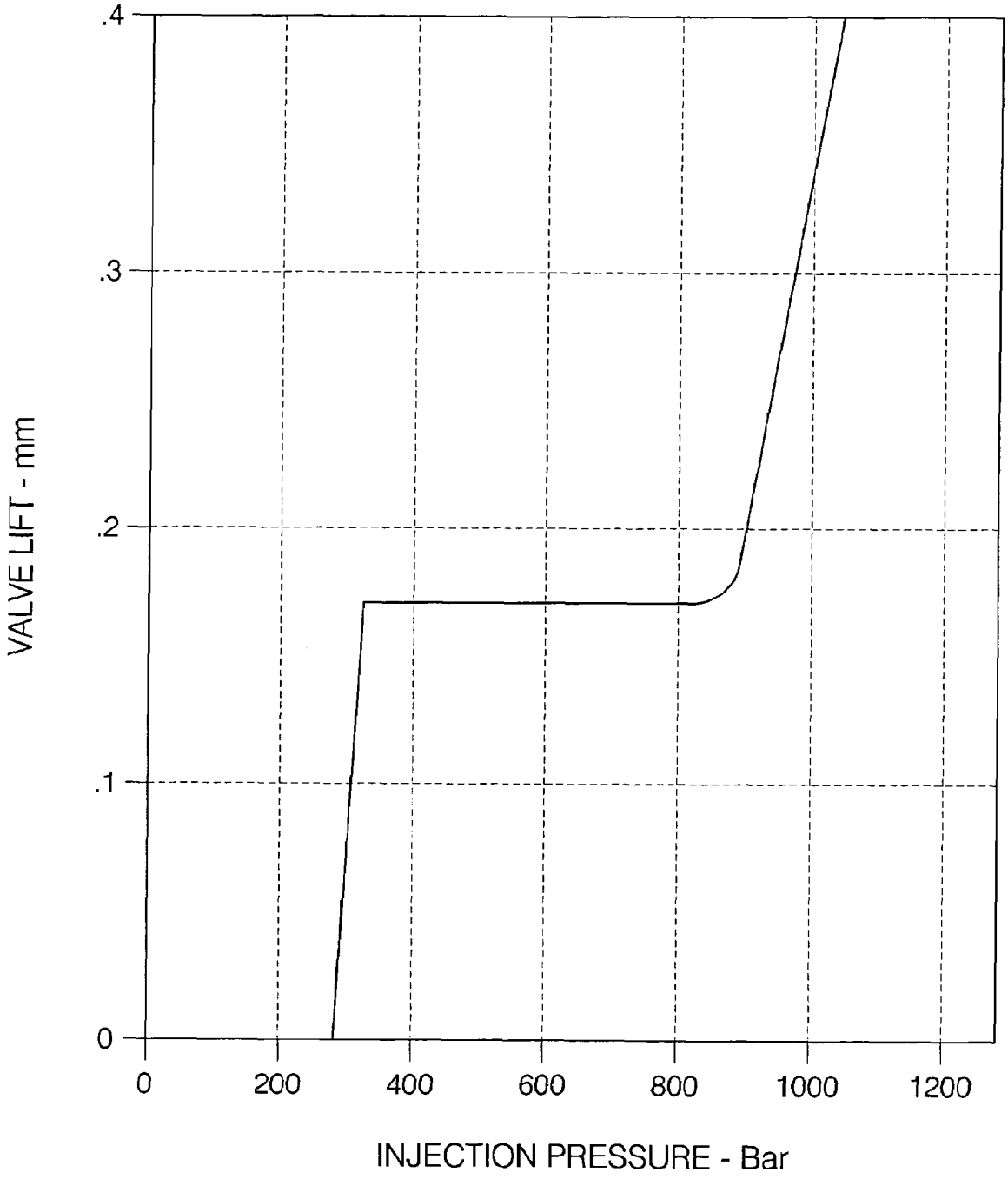
FIG. 6 is a graph illustrating a typical valve needle lift behaviour, under the control of a two-stage lift mechanism, when pressurised fuel is supplied to the fuel injector.

In the preferred embodiment of the present invention the fuel injection nozzle 1 is utilised in an EUI or an EUP with a mechanism for providing a two-stage lift to the valve needle 31. A first stage lift moves the valve needle to the second position and a second stage lift moves the valve needle to the third position. An example of such an EUI known from the prior art and provided with a conventional fuel injection nozzle is shown in FIG. 1. According to the present invention the conventional nozzle would be replaced with the above-described fuel injection nozzle 1. A description of the two-stage lift mechanism is provided below. For the sake of clarity features of the conventional nozzle equivalent to those of the present invention are provided with the relevant reference numerals. A graph showing injection pressure against valve needle lift is shown in FIG. 6.

The two stage lift mechanism 71 is housed within a nozzle holder 73. A distance piece 75 is located between the nozzle holder 73 and the nozzle body 3. The distance piece 75 includes a through bore. A projection 77 from the end of the valve needle 31 projects into the through bore. A spring abutment 79 engages the end of the projection 77.

The nozzle holder 73 defines a spring chamber 81. An extension rod 83 abuts the spring abutment 79 and extends within the spring chamber 81. A first helical compression spring 85 is located around the extension rod 83 and is guided by it. There is a lower spring seat formed by a shim 87, which is interposed between the spring 85 and spacer 88, and an upper spring seat 89. Between the upper and lower spring seats a lift control rod 83 is interposed.

A second helical compression spring 91 is located around the first spring 85 within the nozzle holder 73. A shim 93 abutting a step defined by the upper surface of the distance piece 75 provides a lower spring seat. A shim 95 abutting the nozzle holder 73 provides an upper spring seat.

The dimensions of the spring abutment 79 are such that upon movement of the valve needle 31 away from the valve seat 19 the spring abutment is engageable with the shim 93 to compress the second spring 91.

In operation, to place the valve needle 31 into the first stage lift position, in which it is partially lifted from the valve seat 19, fuel at an intermediate pressure is supplied to the fuel delivery chamber 49 via the fuel inlet 17. The upwardly directed force generated by the pressurised fuel acting against the thrust surfaces 51,53 of the valve needle 31 is sufficient to overcome the force from the first spring 85 acting downwardly on the upper end of the valve needle 31, via the spring abutment 79, and hence the valve needle 31 lifts. The upward movement of the valve needle 31 is stopped when the spring abutment 79 comes into contact with the shim 93 because the force acting on the valve needle 31 is insufficient to overcome the additional downwardly acting spring force of the second spring 91 which acts on the spring abutment 79.

To place the valve needle 31 into the second stage lift position in which it is fully lifted the pressure of the fuel supplied to the fuel delivery chamber 49 is raised to a level at which the force acting on the thrust surfaces 51,53 is sufficient to overcome the spring force of the first spring 85, combined with the preload of the second springs 91.

When it is desired to cease injection by placing the valve needle 31 into the first, seated, position, the pressure of the fuel supplied to the fuel delivery chamber 49 is reduced to a level such that the downwardly acting force from springs 85,91 is sufficient to overcome the upwards force acting on the thrust surfaces 51,53.

Therefore, when it is desired to operate the engine in a premixed combustion mode, e.g. an HCCI mode, i.e. to inject fuel primarily through spray hole 25, fuel at an intermediate pressure is supplied to the fuel delivery chamber 49. This is consistent with the demand for a relatively low pressure fuel injection in a premixed combustion mode.

When it is desired to operate the engine in a conventional combustion mode, i.e. to inject fuel primarily through spray holes 21, fuel at a high pressure is supplied to the fuel delivery chamber 49. This is consistent with the demand for a relatively high pressure fuel injection in the conventional combustion mode.

Figure 7:
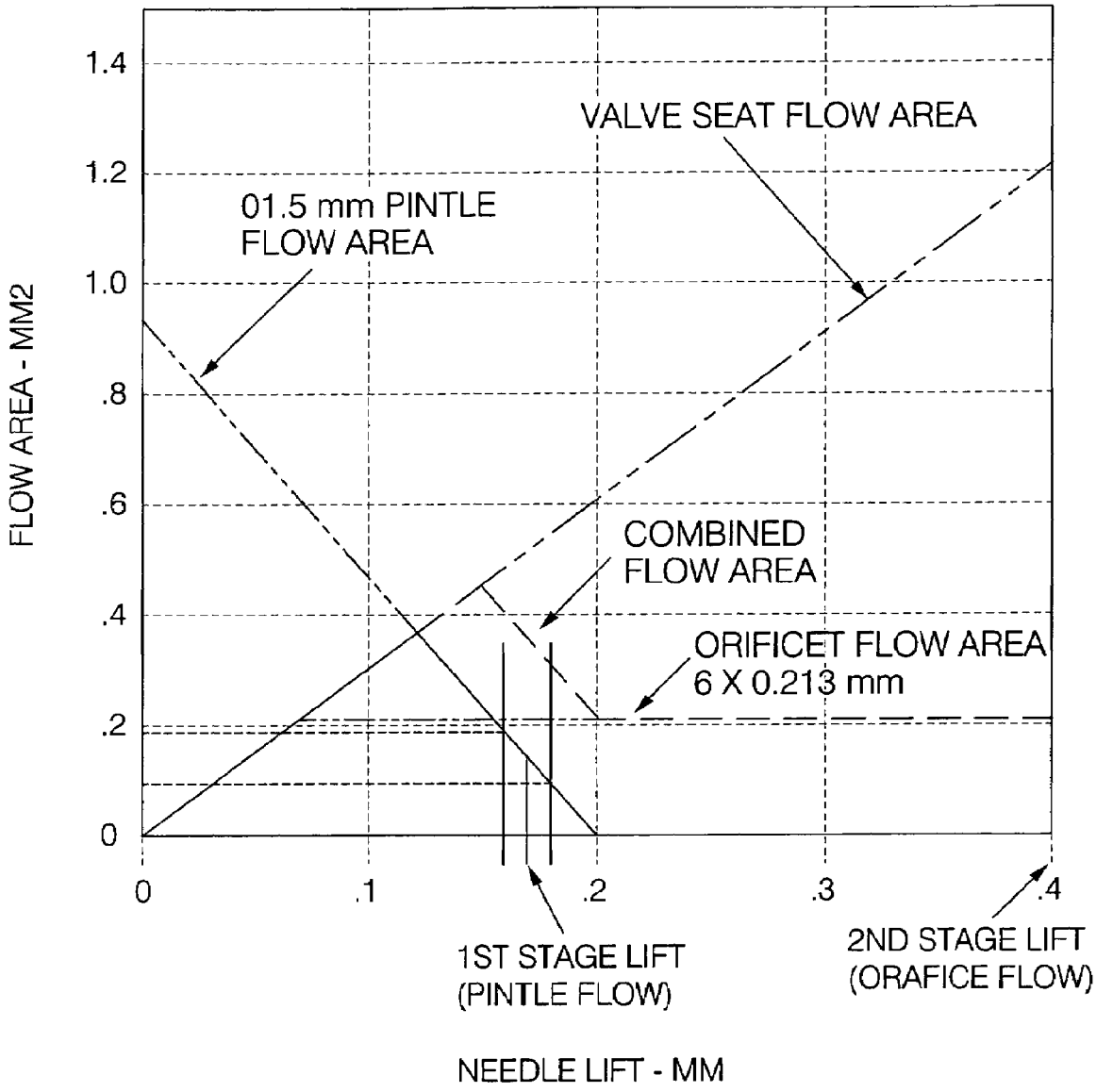
FIG. 7 is a graph illustrating a typical fuel flow area for a fuel injector nozzle according to the present invention resulting from the lift of the value needle from the valve seat.

As the valve needle 31 lifts the fuel flow area between the valve member 39 on the valve needle tip 37 and the valve seat 19 on the nozzle body 3, referred to as the valve seat flow area, increases in a linear manner, as shown in FIG. 7. At the same time the fuel flow area between the obturator piston 41 and the end face of the nozzle body 3, referred to as the pintle flow area, decreases in a linear manner.

In the preferred embodiment the intermediate pressure, i.e. that required to move the valve needle 31 into the first stage lifted position, is in the region of 300 bar, as shown in FIG. 6. In order to move the valve needle 31 into the second stage fully lifted position, a fuel pressure in the region of 900 bar must be supplied. In a premixed combustion mode an injection pressure in the range of 350 to 550 bar might be demanded.

This arrangement ensures that the first stage lift position of the valve needle 31 and the second stage lift position of the valve needle 31 can be maintained for a range of pressures. This may be necessary if the fuel supply mechanism cannot be relied upon to accurately supply fuel at two discrete pressures, and also due to the effect of differently sized components falling within the allowable manufacturing tolerances and variations in the friction within the injector mechanism which may cause hysteresis in operation.

When it is desired to make an injection of fuel in a premixed combustion mode, fuel at a pressure typically between 300 and 600 bar is supplied to the fuel injection nozzle 1 to lift the valve needle 31 to the first stage lifted position. The valve needle 31 lifts from the valve seat 19 against the preload of the first stage spring 85. If the pressure of the supplied fuel falls within the above recited range, the valve needle 31 moves until its movement is arrested in the first stage lifted position by the shim 93. Typically, the needle lift at this stage is 0.175 mm, as shown in FIG. 7. Fuel flows past the valve seat 19 and is directed on to the flow shaping region 43 of the valve needle tip 37 which creates a spray in the form of a hollow sheet cone. Such a spray profile mixes readily with the swirling air in the cylinder.

When the valve needle 31 is in the first stage lifted position the total fuel flow area is the sum of the pintle flow area, i.e. the flow through the axial spray hole 25 and the fuel flow area through the radial spray holes 21, referred to in FIG. 7 as the Orifice Flow Area. In this position some fuel will exit the nozzle body via the radial spray holes 21. However, because of the dynamic characteristics of the fuel flowing over the valve seat 19 and the profile of the spray shaping region 43 relatively little fuel will pass through the radial spray holes 21, and the majority of the fuel will exit the nozzle body 3 through axial spray hole 25.

When it is desired to make an injection of fuel in a diffusion combustion mode, fuel at a pressure in excess of 900 bar is supplied to the fuel injection nozzle 1. The valve needle 31 lifts against downwardly acting forces from the first and second springs 85,91 into the second stage fully lifted position.

Typically, the full needle lift is 0.4 mm, as shown in FIG. 7. When the valve needle 31 is fully lifted the obturator piston 41 is located within the axial spray hole 25. Typically, the obturator piston 41 may enter the axial spray hole 25 by 0.2 mm. This is shown in FIG. 7 as the pintle flow area is nominally reduced to zero when the valve needle 31 is lifted by 0.2 mm, i.e. when the obturator piston 41 is level with the bottom of the axial spray hole 25, the valve needle 31 lifting a further 0.2 mm to its fully lifted position.

There is only a nominally zero flow area at the spray hole 25 when the valve needle 31 is lifted by 0.2 mm because of the small clearance between the obturator piston 41 and the spray hole 25. In use, there is little fuel flow from the axial spray hole 25. High pressure fuel, typically in the range of 1,000 bar to 2500 bar is now present within the nozzle body 3. This fuel is injected through radial spray holes 21 in a conventional way for a valve covers orifice (VCO) arrangement.

When the valve needle 31 is fully lifted typically 90% of the injected fuel will exit the nozzle body 3 via the radial spray holes 21 and 10% will exit the nozzle body 3 via the clearance between the obturator piston 41 and the axial spray hole 25.

The fuel flowing through the clearance between the obturator piston 41 and the axial spray hole 25 will be injected substantially co-axially with the longitudinal axis of the nozzle body 3. In use, the clearance will tend to close up as carbon is deposited on the obturator piston 41 and the axial spray hole 25.

Any fuel that does flow through the axial spray hole 25 will be poorly atomised and will be injected into the centre of the cylinder where there is little air movement. For a conventional swirl supported combustion system that has been optimised for circa 150 degree cone angle sprays this will result in the fuel being converted into smoke and particulates. The generation of such smoke and particulates is unacceptable.

FIG. 8 shows a sectional view of a piston 201 intended for use with the above-described fuel injector 1 according to the present invention. The crown of the piston 201 is provided with a circular bowl 203. The surface of the bowl 203 is of a conventional toroidal form. That is, there is an upper lip 205 level with the top of the piston 201 and a concave annular region 207 which undercuts the lip 205. Aligned centrally within the bowl 203, inside the annular region 207, there is a frustoconical region 209 which tapers to a flat surface 211 just below the level of the bottom edge of the lip 205. The flat surface is provided with a circular opening 213 into a spherical air cell 215 within the frustoconical region 209. The opening 213 is aligned with the longitudinal axis of the centrally located injector 1.

As the piston 201 rises upwards in the cylinder on its compression stroke the air within the cylinder will be forced into the air cell 215 through the circular opening 213. In a diffusion combustion mode when fuel injection takes place with the piston 201 near TDC, the primary injection of fuel through the radial spray holes 21 will issue into the toroidal part of the piston bowl 203. The secondary injection of fuel through the clearance between the axial spray hole 25 and the obturator piston 41 will issue into the air cell 215 through the opening 213.

The fuel injection equipment according to the present invention may be utilised to operate an engine according to a number of strategies.

For example, when the engine is idling the FIE can be operated in a diffusion combustion mode. Fuel can be supplied to the fuel injector 1,301,401 at a pressure in excess of 900 bar such that the valve needle 31 is raised to the second stage lifted position.

When the engine is operating at a speed above the idle speed and at part-load, an early injection for a premixed combustion mode, as shown in strategy A of FIG. 11 can be used. Fuel can be supplied to the injector 1,301,401 at a pressure in the range of 300 bar to 900 bar such that the valve needle 31 is lifted to the first stage lifted position.

At part-load a combined combustion mode strategy having multiple fuel injections within a single combustion cycle can be utilised. Such a strategy is illustrated as strategy C in FIG. 11. There may be one, or more, early low pressure premixed combustion made fuel injections followed by one, or more, late, high pressure diffusion combustion mode fuel injections around TDC.

A portion of the injected fuel is delivered in the early premixed combustion mode fuel injection and the remainder of the fuel is delivered in the late diffusion combustion mode fuel injections. Strategy C also illustrates a late injection of fuel through the spray hole for a diffusion combustion mode during which fuel is introduced into the cylinder for the purposes of creating an exotherm in the exhaust for after treatment regeneration.

When the engine is operating at high load the FIE can be operated in a diffusion combustion mode as illustrated by strategy B in FIG. 11 and as described above.

Although FIG. 11 illustrates only single injections within each combustion made, multiple injections are envisaged.

Also, the strategies A, B and C may be employed at different points over the speed and load map of the engine as required.

Furthermore, the late injection shown in strategy C may be employed in strategies A and B if necessary.

All of the aforementioned injection strategies may be equally applied to 2 stroke, 4 stroke, 6 stroke or 8 stroke engines.

FIG. 9 shows an alternative design of valve needle tip 337 for a fuel injection nozzle 301 according to the present invention. On the lower part of the flow shaping region 343 and the upper part of the obturator piston 341 there are provided four flat sections 350, radially equally spaced around the valve needle tip 337.

The provision of flat sections 350 on the valve needle tip 337 provides a multi-jet spray pattern, rather than the thin sheet hollow cone spray formed by pintle obturator 37 of the first described embodiment.

FIG. 10 shows an alternative design of nozzle body 403 for a fuel injection nozzle 401 according to the present invention. The features of the fuel injection nozzle 401 are the same as those described for fuel injection nozzle 1 and 301 as described above, with the exception that the frustoconical lower part of the nozzle body 403 is provided with a concentric strengthening ring 404 which at its upper part adjoins the nozzle body 403 and which tapers outwardly in a downwards direction so that its diameter at its lower region is greater than its diameter at its upper region. As the strengthening ring 404 is hollow it does not interfere with the fuel injection spray from the axial hole 425.

The invention claimed is:

1. A fuel injection apparatus for a fuel injector nozzle, the apparatus comprising:

a nozzle body and a moveable valve needle slideably located within the nozzle body;

wherein the nozzle body has a plurality of radial fuel outlets, at least one axial fuel outlet, an external surface, and an internal surface defining a valve seat positioned between a fuel supply path and the fuel outlets;

wherein the valve needle comprises:

a valve face that engages with the valve seat when the valve needle is in a seated position such that a fluid-tight seal is formed between the fuel supply path and the fuel outlets, an obturator piston that is engageable with the at least one axial fuel outlet, a spray shaping region having, at least in part, a concave, necked profile located between the valve seat and the obturator piston, wherein the profile of the valve needle transitions smoothly between the valve seat, spray shaping region, and obturator piston; and a two-stage lift mechanism for enabling lift of the valve needle;

wherein each of the fuel outlets passes through the nozzle body from the internal surface to the external surface;

wherein, in a first stage lifted position of the valve needle, the valve face is spaced apart from the valve seat, and the obturator piston is positioned such that a fuel flow passage is opened between the obturator piston and the axial fuel outlet; and wherein, in a second stage lifted position, the valve face is spaced further apart from the valve seat and the obturator piston is positioned such that the fuel flow passage between the obturator piston and the axial fuel outlet is substantially closed;

wherein, in use, the profile of the spray shaping region encourages fuel passing the surface of the valve needle to be attached to it.

2. A fuel injection apparatus as claimed in claim 1 wherein an entry passage to each radial fuel outlet is positioned on the valve seat, and wherein, when the valve needle is in the seated position, the valve face covers the entry of each radial fuel outlet.

3. A fuel injection apparatus as claimed in claim 1 wherein the apparatus defines an annular volume around the valve needle tip, wherein, in use, fuel flows through the volume and across the obturator piston.

4. A fuel injection apparatus as claimed in claim 1 wherein the obturator piston is a close fit within the axial fuel outlet such that, in use, when the valve needle is in a second stage lifted position, fuel flow past the obturator piston is minimised.

5. A fuel injection apparatus as claimed in claim 1, wherein the apparatus defines a clearance between the external profile of the obturator piston and the internal profile of the axial fuel outlet such that, in use, when the valve needle is in a second stage lifted position a desired fuel flow past the obturator piston is obtained.

6. A fuel injection apparatus as claimed in claim 1 wherein the valve needle further comprises a balancing groove around the periphery of a lower end of the valve needle, wherein the balancing groove, in use, acts to centralise the valve needle within the nozzle body.

7. A fuel injection apparatus as claimed in claim 1, the body of the fuel injector nozzle further comprising a reinforcing ring around the axial fuel outlet.

8. A fuel injection apparatus as claimed in claim 7, wherein the diameter of the reinforcing ring increases towards its lower end.

9. A fuel injection apparatus as claimed in claim 1 further comprising a fuel supply mechanism which, in use, can supply pressurised fuel to the nozzle body within two discrete ranges of pressure.

10. A fuel injection apparatus as claimed in claim 7, wherein the fuel supply mechanism is an electronic unit pump.

11. A fuel injection apparatus as claimed in claim 1 wherein the two-stage lift mechanism comprises a first resilient element and a second resilient element arranged in parallel and acting downwardly upon the valve needle wherein, in use, to lift the valve needle to the first stage lifted position an upwardly acting force in excess of the preload of the first resilient element needs to be applied to the valve needle and to lift the valve needle to the second stage lifted position an upwardly acting force in excess of the spring force of the first resilient element and the preload of the second resilient element needs to be applied to the valve needle.

12. A fuel injection apparatus as claimed in claim 1 wherein the valve needle is provided around its periphery at its lower end with a plurality of recessed areas, such that, in use, the fuel injected from the axial fuel outlet has a multi-jet pattern.

13. A fuel injection apparatus as claimed in claim 3, when the valve needle is in a first stage lifted position or a second stage lifted position the aggregate flow area of the fuel outlets is the smallest flow area in the fuel supply path.

14. An internal combustion engine comprising a fuel injector, a fuel supply means, and a reciprocating piston, the fuel injector comprising a nozzle body provided with a plurality of radial fuel outlets and an axial fuel outlet, a moveable valve needle which allows or prevents fuel flow through the radial and axial fuel outlets, and a lift mechanism which controls movement of the valve needle under the influence of pressurised fuel provided by the fuel supply means, the reciprocating piston comprising a combustion chamber having a secondary combustion cavity provided with an inlet, wherein the inlet is arranged relative to the axial fuel outlet of the fuel injector such that, in use, when the reciprocating piston is at or near a top dead centre position, fuel passing through the axial fuel outlet is directed into the secondary combustion cavity, characterised in that, when the fuel supply means supplies fuel to the injector at a first pressure the lift mechanism raises the valve needle to a first lifted position, wherein a first portion of the injected fuel is injected through the axial fuel outlet and in that when the fuel supply means supplies fuel to the injector at a second pressure the lift mechanism raises the valve needle to a second lifted position wherein a second portion of the injected fuel is injected through the radial fuel outlets.

15. An internal combustion engine as claimed in claim 14 wherein when the valve needle is in the first lifted position, the first portion of the injected fuel is the majority quantity of the injected fuel and the minority quantity of the injected fuel is injected through the radial fuel outlets and in that when the valve needle is in the second lifted position the second portion of the injected fuel is the majority quantity of the injected fuel and the minority quantity of the injected fuel is injected through the axial fuel outlet.

16. An internal combustion engine as claimed in claim 15 wherein when the valve needle is in the first lifted position the minority quantity of fuel injected through the radial fuel outlets is minimised and when the valve needle is in the second lifted position the minority quantity of fuel injected through the axial fuel outlet is minimised.

17. An internal combustion engine as claimed in any one of claims 14, 15 and 16, wherein the lift mechanism is a two-stage lift mechanism and the valve needle can be raised to a first stage position and a second stage position.

18. An internal combustion engine as claimed in any one of claim 14, claim 15 or claim 16 wherein the secondary combustion cavity is spherical.

19. A method of operating a dual combustion mode fuel injection system comprising the steps of: supplying fuel to a fuel injector at a first, relatively low, pressure such that a first injection event occurs in which a majority of the fuel is injected through a nozzle outlet path for a premixed combustion mode and a minority of the fuel is injected through a nozzle outlet path for a diffusion combustion mode; supplying fuel to the fuel injector at a second, relatively high, pressure such that a second injection event occurs in which a majority of the fuel is injected through a nozzle outlet path for a diffusion combustion mode and a minority of the fuel is injected through a nozzle outlet path for a premixed combustion mode; wherein in the second injection event the fuel injected through the nozzle path for a diffusion combustion mode is burned in a primary combustion event and the fuel injected through the nozzle path for a premixed combustion mode is burned in a secondary combustion event; and wherein the combustion gases from the secondary combustion event re-energise the primary combustion event.

20. A method of operating a dual combustion mode fuel injection system as claimed in claim 19 wherein during the first injection event the secondary injection of fuel through the nozzle outlet path for a diffusion combustion mode is minimised and during the second injection event the secondary injection of fuel through the nozzle outlet path for a premixed combustion mode is minimised.

21. A method of operating a dual combustion mode fuel injection system as claimed in claim 19 or claim 20, wherein during the first injection event the secondary injection of fuel through the nozzle outlet path for a diffusion combustion mode is optimised and during the second injection event the secondary injection of fuel through the nozzle outlet path for a premixed combustion mode is optimised.

22. A method of operating a dual combustion mode fuel injection system A diesel engine as claimed in claim 19 or claim 20 wherein the fuel injected in the first injection event is at a relatively low pressure and the fuel injected in the second injection event is at a relatively high pressure.

23. A method of operating a dual combustion mode fuel injection system as claimed in claim 19 or 20 wherein in the second injection event the secondary combustion event is conducted in a separate combustion chamber and the primary combustion event is re-energised by ejecting the combustion gases from the first combustion chamber to the second combustion chamber substantially only along the axis of the nozzle outlet path for a premixed combustion mode.

* * * * *